US006713667B2

(12) United States Patent
Shigenaga

(10) Patent No.: US 6,713,667 B2
(45) Date of Patent: Mar. 30, 2004

(54) FOOT PEDAL FOR DRUMS

(75) Inventor: Fumihiro Shigenaga, Hamakita (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/127,605

(22) Filed: Apr. 23, 2002

(65) Prior Publication Data

US 2002/0152873 A1 Oct. 24, 2002

(30) Foreign Application Priority Data

Apr. 24, 2001 (JP) ..... P2001-126161

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 3,030,847 A * 4/1962 Thompson ..... 84/422.1
4,198,894 A * 4/1980 Della-Porta et al. ..... 84/422.1

FOREIGN PATENT DOCUMENTS

DE 4020794 1/1991

OTHER PUBLICATIONS

European Search Report dated Aug. 01, 2002.
English translation of portion of Japanese Sonor catalog by Yamaha.

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A foot pedal unit for use in a drum set comprises a beater, a rotation shaft, a pair of support poles for rotatably supporting the rotation shaft, and a foot pedal connected to the rotation shaft. The foot pedal unit provides an automatic return structure that comprises a tension coil spring whose upper end is connected to a crank arm at one end of the rotation shaft via a first roller, an adjustment screw, and a second roller by which the lower end of the tension coil spring is connected with the adjustment screw. Due to the provision of the automatic return structure, the beater and foot pedal are automatically returned to their initial positions without causing unwanted friction or noise at the lower end of the tension coil spring that is expanded or contracted when the player depresses the foot pedal with his/her foot.

7 Claims, 5 Drawing Sheets

FOOT PEDAL FOR DRUMS

BACKGROUND OF THE INVENTION

1. Field of the Invention

This invention relates to foot pedals that are depressed by feet of players to strike drums by beater heads. In particular, the foot pedals use tension springs to apply return characteristics to beaters and the like.

2. Description of the Related Art

Foot pedals are arranged for drum sets to allow players to depress them with their feet. When a player depresses the foot pedal with his/her foot, a beater is correspondingly revolved or moved towards a drum (e.g., a bass drum) so that a beater head (or mallet) strikes it to produce a corresponding drum sound. Conventionally, there are provided various types of structures and methods for improvements in the performability of the foot pedal for use in the drum set.

FIG. 4 shows the basic structure of the conventional foot pedal unit for use in the drum set. Herein, a pair of beaters 1 are attached to a rotation shaft 2, which is pivotally and rotatably supported by upper ends of a pair of support poles 3. The tip end of a foot pedal 4 (whose upper portion is only illustrated in FIG. 4) is interconnected to the prescribed position of the rotation shaft 2 between the attached positions of the beaters 1 by means of a transmission member 5 such as a chain or a plate-like member. A tension coil spring 6 is provided to apply a return characteristic to the foot pedal 4 so that the foot pedal 4 is automatically returned to its original position. One tension coil spring 6 can be arranged to engage with one end of the rotation shaft 2, or a pair of tension coil springs 6 can be arranged to engage with both ends of the rotation shaft 2, which is shown in FIG. 4. Herein, the upper end 6A of the tension coil spring 6 is hung on a roller 9, which is rotatably supported by a crank arm 7, via a link member 8. The lower end 6B of the tension coil spring 6 is hung in a through hole 10A of an adjustment screw 10, which is used to adjust the tension of the tension coil spring 6.

FIG. 5 shows the detailed structure around the adjustment screw 10 that is connected with the lower end 6B of the tension coil spring 6 via the through hole 10A. The adjustment screw 10 engages with a nut 11, which is rotatably supported by a support hole 13. The base portion of the support hole 13 is arranged at a bracket 12 that is an integral part of the support pole 3 and is horizontally projected from the support pole 3. A tapped hole 14 is formed to horizontally and partially penetrate through the bracket 12 in such a way that it rectangularly crosses the axial direction of the support hole 13. A fastening bolt 15 for fixing the nut 11 at the prescribed position is engaged with the tapped hole 14. Therefore, by merely revolving the nut 11 in a clockwise or counterclockwise direction, the adjustment screw 10 ascends up or descends down so that the tension of the tension coil spring 6 can be adjusted.

In the musical performance using the drums equipped with the aforementioned foot pedal unit, the player depresses the foot pedal 4 with his/her foot to cause a certain revolution of the rotation shaft 2 by means of the transmission member 5, so that the beaters 1 are forced to move towards the drumhead of the bass drum and the like. Accompanied with the revolution of the rotation shaft 2, the tip ends of the crank arms 7 correspondingly revolve to slightly ascend up. Hence, the tension coil springs 6 whose upper ends 6A are hung on the rollers 9 by the link members 8 are expanded to cause increases of their tensions, which in turn cause the increase of the load imparted to the beaters 1 and the foot pedal 4 via the rotation shaft 2. In addition, this causes displacements in the lower ends 6B of the tension coil springs 6, so that some friction may occur in the through holes 10A of the adjustment screws 10.

In the conventional foot pedal unit, the lower ends 6B of the tension coil springs 6 are directly hung on the through holes 10A of the adjustment screws 10, wherein there are provided very small contact areas between the lower ends 6B and the through holes 10A. That is, very large contact resistances occur therebetween because high loads are concentrated on the small contact areas. This may cause unpleasant noise during the playing of the drums. In addition, this may provide a bad influence to the player's operation of the pedal. A lubricant may be effective to solve such drawbacks. However, there are provided small effective areas of the lubricant between the tension coil springs 6 and the adjustment screws 10. Hence, the lubricant may be run out in a relatively short period of time. Thus, it is difficult to demonstrate the effectiveness of the use of the lubricant to overcome the aforementioned drawbacks.

SUMMARY OF THE INVENTION

It is an object of the invention to provide a foot pedal unit that ensures a smooth operation for a pedal for beating a bass drum when depressed with a player's foot, while avoiding occurrence of unpleasant noise due to mechanical contacts between an adjustment screw and a tension coil spring repeatedly extended or contracted during playing of the bass drum.

This invention provides a foot pedal unit for use in a drum set that comprises a beater, a rotation shaft, a pair of support poles for rotatably supporting the rotation shaft, and a foot pedal connected to the rotation shaft. The foot pedal unit provides an automatic return structure that comprises a tension coil spring whose upper end is connected to a crank arm at one end of the rotation shaft via a first roller, an adjustment screw that is manually adjusted in height, and a second roller by which the lower end of the tension coil spring is connected with the adjustment screw. Due to the provision of the automatic return structure, the beater and foot pedal are automatically returned to their initial positions without causing unwanted friction or noise at the lower end of the tension coil spring that is extended or contracted when the player depresses the foot pedal with his/her foot because the second roller substantially absorbs the positional displacement of the lower end of the tension coil spring.

In the above, the lower end of the tension coil spring is connected with the second roller that is held by a holder attached to the adjustment screw. In addition, the adjustment screw engages with a nut that is fixed to a bracket, which is projected and formed as an integral part of the support pole.

BRIEF DESCRIPTION OF THE DRAWINGS

These and other objects, aspects, and embodiments of the present invention will be described in more detail with reference to the following drawing figures, in which.

DESCRIPTION OF THE PREFERRED EMBODIMENT

This invention will be described in further detail by way of examples with reference to the accompanying drawings.

Figure 1:
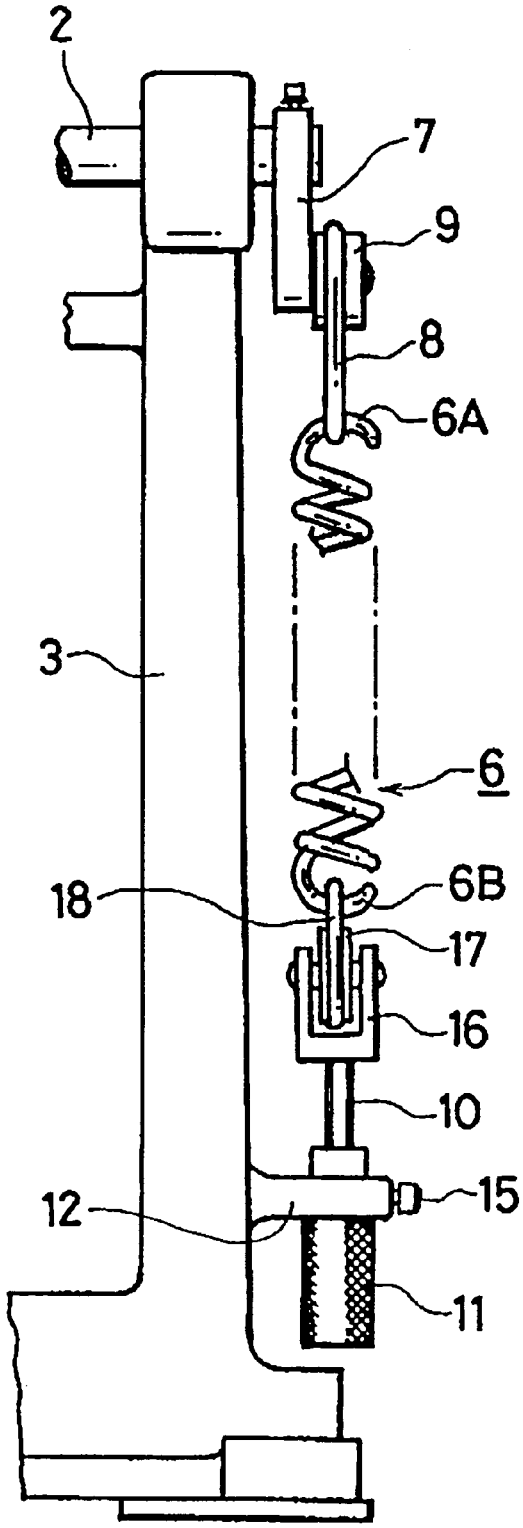
FIG. 1 is a front view showing essential parts of a foot pedal unit in accordance with one embodiment of the invention.
Figure 2:
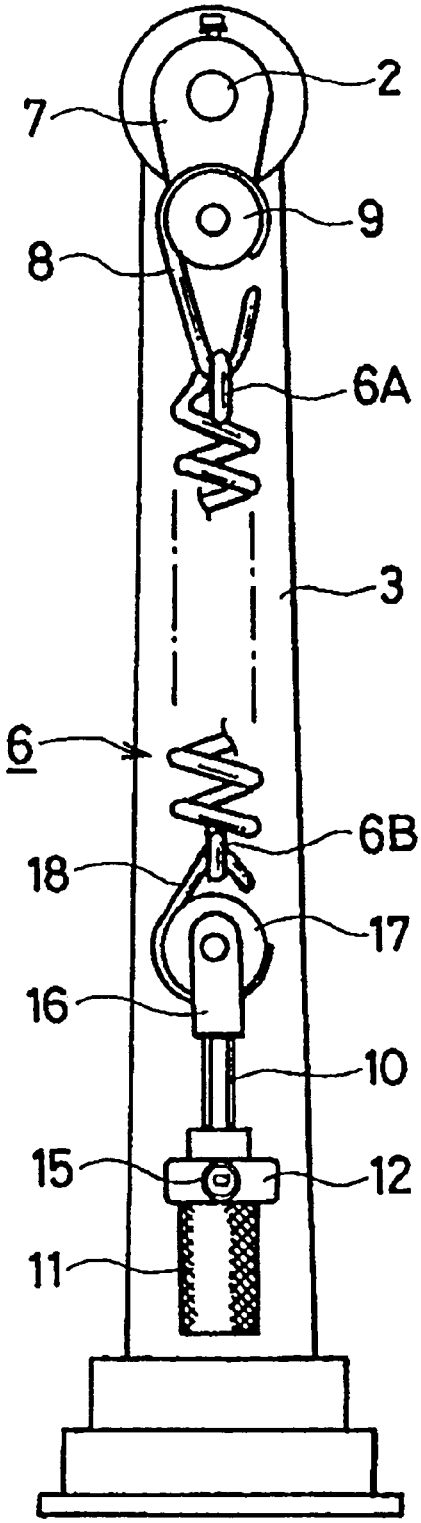
FIG. 2 is a side view showing the essential parts of the foot pedal unit in the initial condition.
Figure 4:
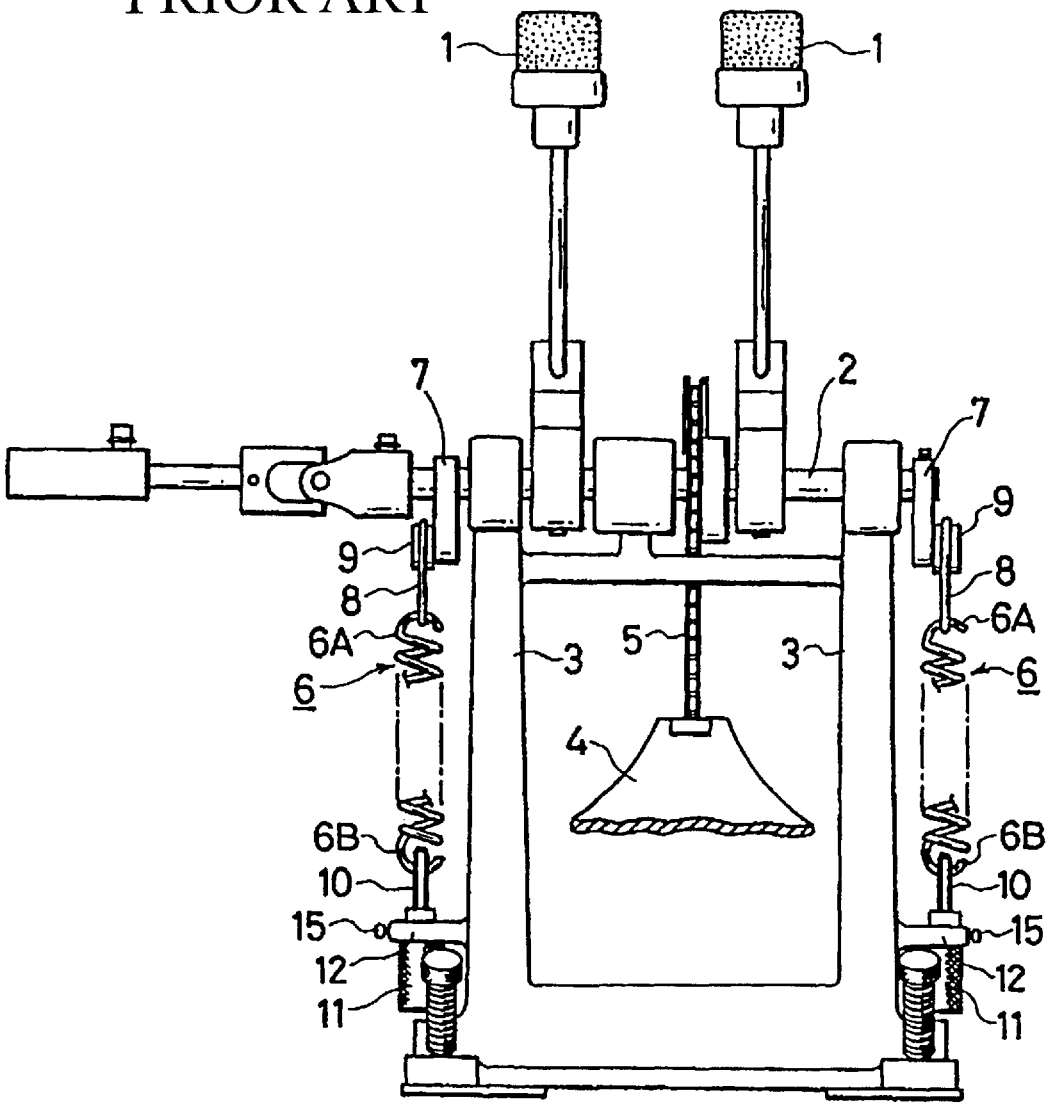
FIG. 4 PRIOR ART
FIG. 4 is a front view showing the mechanical structure of a foot pedal unit that is conventionally used for a drum set.
Figure 5:
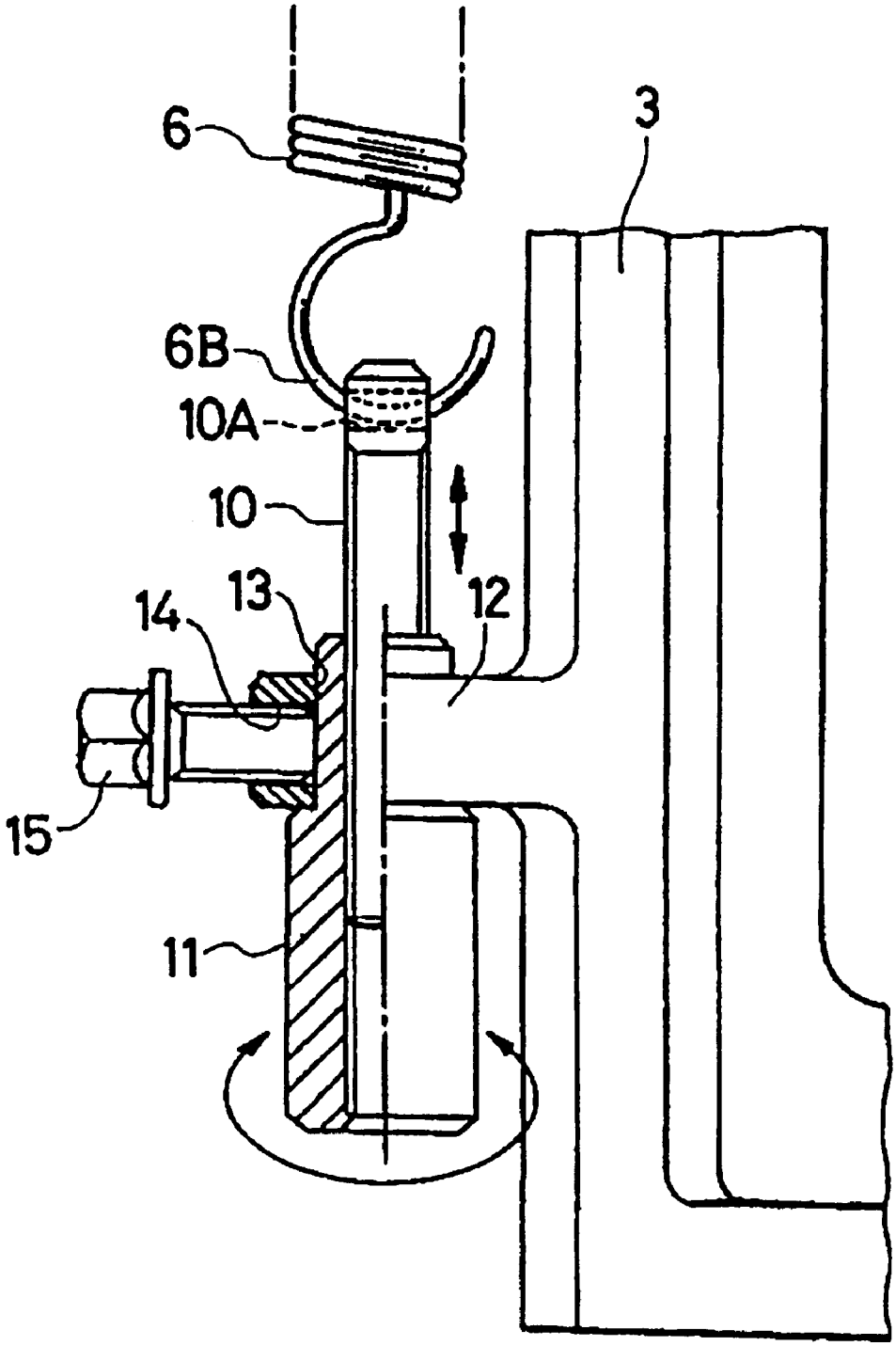
FIG. 5 PRIOR ART
FIG. 5 is an enlarged view partly in section showing essential parts around the adjustment screw in the foot pedal unit shown in FIG. 4.

FIGS. 1 and 2 show essential parts of a foot pedal unit in accordance with one embodiment of the invention, wherein the parts identical to those shown in FIGS. 4 and 5 are designated by the same reference numerals; hence, the detailed description thereof will be omitted as necessary.

In the present embodiment, reference numeral 3 designates a support pole that is formed by the aluminum die cast. Similar to the aforementioned foot pedal unit shown in FIG. 4, there are provided a pair of the 'aluminum' support poles 3 on both sides of the foot pedal 4. The rotation shaft 2 is pivotally supported by the upper ends of the support poles 3.

The present embodiment is characterized by providing a brand-new automatic return structure at one end or each of both ends of the rotation shaft 2. In the automatic return structure shown in FIGS. 1 and 2, a crank arm 7 is fixed to one end of the rotation shaft 2, and a roller 9 is rotatably supported by the tip end of the crank arm 7. A tension coil spring 6 is provided relative to the support pole 3 in order to apply a return characteristic to the foot pedal 4. The upper end 6A of the tension coil spring 6 is hung on the roller 9 by means of a link member 8.

A bracket 12 is formed as an integral part of the support pole 3 at its base portion. A nut 11 is attached to the bracket 12 in accordance with the foregoing structure shown in FIG. 5. A holder 16 is attached to the tip end of an adjustment screw 10, so that a roller 17 is rotatably supported by the holder 16. The lower end 6B of the tension coil spring 6 is hung on the roller 17 by means of a link member 18.

When the player plays the drum set equipped with the foot pedal unit of the present embodiment, the rotation shaft 2 revolves every time the player depresses the foot pedal 4 with his/her foot, wherein the crank arm 7 is correspondingly revolved so that its tip end automatically ascends up. Thus, the roller 9 attached to the tip end of the crank arm 7 moves upwards to expand the tension coil spring 6 against its tension (or contraction) while guiding the link member 8 outwardly from the support pole 3, which is shown in FIG. 3.

Figure 3:
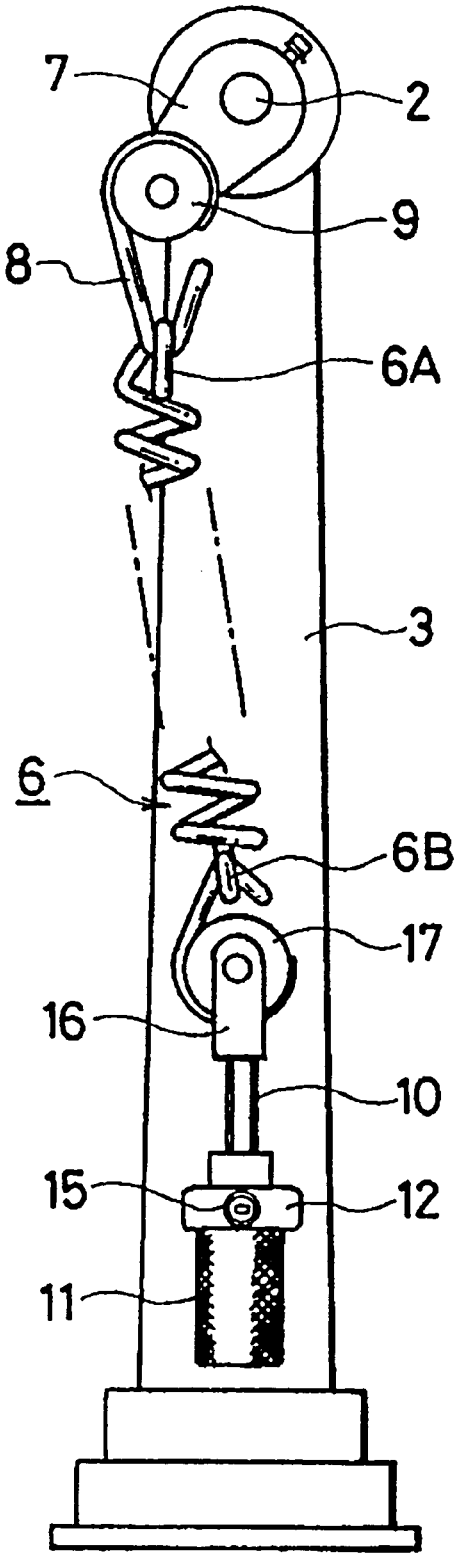
FIG. 3 is a side view showing the essential parts of the foot pedal unit that are slightly moved in response to a player's operation for depressing a foot pedal.

In FIG. 3, the tension coil spring 6 is slightly inclined from its initial vertical position with respect to the fulcrum corresponding to the roller 17. Herein, the positional displacement is substantially absorbed by the revolution of the roller 17, which in turn avoids occurrence of contact friction with respect to the lower end 6B of the tension coil spring 6.

In summary, the present embodiment provides a completely novel foot pedal unit for use in the drum set, wherein even though a small positional displacement occurs at the lower end of the tension coil spring due to the player's operation of the foot pedal, it can be reliably absorbed by the revolution of the roller that is attached to the lower end of the tension coil spring. Therefore, it is possible to reliably avoid occurrence of unpleasant noise during the performance of the drum set equipped with the foot pedal unit. In addition, substantially no resistance is additionally applied to the player's operation of the pedal because of the 'smooth' revolution of the roller. Therefore, it is possible to provide noticeable effects for stabilizing the drum performance using the foot pedal.

Incidentally, the present embodiment employs the holder 16 and roller 17 for avoiding unwanted friction and noise at the lower end of the tension coil spring 6. Of course, this invention is not necessarily limited to use the aforementioned elements 16 and 17. In addition, the present embodiment is designed in such a way that the lower end of the tension coil spring is directly connected to the roller. In order to ensure the smooth movement of the roller, it is possible to additionally provide a bearing.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A foot pedal unit for a drum set comprising:

a beater;

a rotation shaft to which the beater is attached at a prescribed position;

a pair of support poles whose upper ends rotatably support the rotation shaft;

a foot pedal whose tip end is interconnected to the rotation shaft by a transmission member; and an automatic return structure that automatically returns the beater and the foot pedal when a player depresses the foot pedal with his/her foot, the automatic return structure comprising:

a tension coil spring whose upper end is connected with a crank arm that is attached to one end of the rotation shaft via a first roller, an adjustment screw that is fixed to a lower portion of the support pole and is manually adjustable in height, and a second roller attached to the adjustment screw, the lower end of the tension coil spring being rotatably coupled to the second roller.

2. The foot pedal unit for a drum set according to claim 1, wherein the adjustment screw engages with a nut that is fixed to a bracket, which is projected and formed as an integral part of the support pole.

3. The foot pedal unit for a drum set according to claim 1, wherein the adjustment screw engages with a nut that is fixed to a bracket, which is projected and formed as an integral part of the support pole.

4. A foot pedal unit for a drum set comprising:

a beater;

a rotation shaft to which the beater is attached at a prescribed position;

a pair of support poles whose upper ends rotatably support the rotation shaft;

a foot pedal whose tip end is interconnected to the rotation shaft by a transmission member; and an automatic return structure that automatically returns the beater and the foot pedal when a player depresses the foot pedal with his/her foot, the automatic return structure comprising:

a tension coil spring whose upper end is connected with a crank arm that is attached to one end of the rotation shaft via a first roller, an adjustment screw that is fixed to a lower portion of the support pole and is manually adjustable in height, and a second roller connected to the second end of the tension coil spring so that the second end of the tension coil spring rotates around the axis of the second roller in response to rotary movement of the crank arm, the adjustment screw being coupled to the second roller.

5. The foot pedal unit for a drum set according to claim 4, wherein the tension coil spring has a longitude axis in its untensionel state and wherein the longitude axis moves relative to the rotary axis of the second roller in response to rotary movement of the crank arm.

6. The foot pedal unit for a drum set according to claim 4 wherein the adjustment screw engages with a nut that is fixed to a bracket, which is an integral part of the support pole.

7. The foot pedal unit for a drum set according to claim 4, wherein the adjustment screw engages with a nut that is fixed to a bracket which is an integral part of the support pole.

* * * * *